US010953463B2

(12) United States Patent
Kaneko et al.

(10) Patent No.: US 10,953,463 B2
(45) Date of Patent: Mar. 23, 2021

(54) CASTING DEVICE

(71) Applicant: MITSUBISHI HEAVY INDUSTRIES, LTD., Tokyo (JP)

(72) Inventors: Takeshi Kaneko, Tokyo (JP); Masaki Taneike, Tokyo (JP); Hidetaka Oguma, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 211 days.

(21) Appl. No.: 16/082,629

(22) PCT Filed: Mar. 9, 2017

(86) PCT No.: PCT/JP2017/009477
§ 371 (c)(1),
(2) Date: Sep. 6, 2018

(87) PCT Pub. No.: WO2017/155038
PCT Pub. Date: Sep. 14, 2017

(65) Prior Publication Data

US 2019/0084038 A1 Mar. 21, 2019

(30) Foreign Application Priority Data

Mar. 11, 2016 (JP) ..... JP2016-047734

(51) Int. Cl.
*B22D 27/04* (2006.01)
*B22D 30/00* (2006.01)

(52) U.S. Cl.
CPC ..... *B22D 27/045* (2013.01); *B22D 27/04* (2013.01); *F05D 2230/211* (2013.01)

(58) Field of Classification Search
CPC .. B22C 9/04; B22C 9/06; B22C 9/065; B22C 9/10; B22C 9/22; B22C 9/24; B22D 27/00; B22D 27/003; B22D 27/04; B22D 27/045; B22D 30/00; F05D 2230/211
USPC ..... 164/122, 122.1, 122.2, 124, 125, 126, 164/128, 338.1, 348
See application file for complete search history.

(56) References Cited

U.S. PATENT DOCUMENTS

| | | | |
|---|---|---|---|
| 2004/0016529 | A1 | 1/2004 | Graham |
| 2004/0079510 | A1 | 4/2004 | Garlock et al. |
| 2004/0173336 | A1 | 9/2004 | Graham |
| 2005/0022959 | A1 | 2/2005 | Soderstrom et al. |
| 2010/0071812 | A1 | 3/2010 | Schaeffer et al. |

FOREIGN PATENT DOCUMENTS

| | | |
|---|---|---|
| JP | 2005-46911 | 2/2005 |
| JP | 2010-75999 | 4/2010 |
| JP | 2015-167978 | 9/2015 |

OTHER PUBLICATIONS

International Preliminary Report on Patentability dated Sep. 11, 2018 in International (PCT) Application No. PCT/JP2017/009477.
International Search Report dated Apr. 18, 2017 in International (PCT) Application No. PCT/JP2017/009477.

*Primary Examiner* — Kevin P Kerns
(74) *Attorney, Agent, or Firm* — Wenderoth, Lind & Ponack, L.L.P.

(57) ABSTRACT

In a casting device, when a mold varied in outer size depending on a position passes through a heat shielding portion between a heating chamber and a cooling chamber, a flexible portion of a heat shielding body is bent to fit the outer size of the mold.

3 Claims, 8 Drawing Sheets

CASTING DEVICE

TECHNICAL FIELD

The present invention relates to a casting device that produces a casting through directional solidification, and in particular to a heat shielding body that partitions a heating chamber and a cooling chamber for the directional solidification.

BACKGROUND ART

For example, in a turbine blade and other components, the suppression of creep deformation and the improvement of fatigue strength have been sought by using precision casting by means of directional solidification to make the crystal structure columnar crystalline or single crystalline. The casting device sequentially cools a mold poured with a molten metal from one end part toward the other end part, normally from a lower end part toward an upper end part, thereby achieving the directional solidification. The casting device includes a heating chamber and a cooling chamber that are adjacent to each other, and the mold poured in the heating chamber is moved, from the lower end part, to the cooling chamber at a slow speed.

To appropriately advance the directional solidification, formation of steep temperature gradient near a liquidus of the molten metal inside the mold is important. In other words, it is required that temperature equal to or higher than a melting point of the target metal is maintained in a region higher than a solidification interface inside the mold, whereas temperature lower than a solidification point is maintained in a region lower than the solidification interface.

As means to maintain such temperature difference, a heat shielding body that partitions the heating chamber and the cooling chamber is used, for example, as disclosed in JP 2010-75999 A.

In a case where the technology disclosed in JP 2010-75999 A is applied to a casting largely varied in size of a cross-section, however, it is necessary to select a size of the heat shielding body according to the maximum cross-sectional area. Otherwise, a large gap occurs between a surface of the mold and the heat shielding body, which deteriorates effects by the heat shielding body.

Patent Literature

Patent Literature 1: JP 2010-75999 A

SUMMARY OF THE INVENTION

Technical Problem

The present invention is made in consideration of such a situation, and an object of the present invention is to provide a casting device that makes it possible to appropriately perform precision casting using directional solidification.

Solution to Problem

To solve the above-described problem, a casting device according to the present invention includes a heating chamber in which a molten metal is poured into a mold, a cooling chamber that is provided adjacently to the heating chamber and in which directional solidification is performed while the mold poured with the molten metal is moved, and a heat shielding body that partitions the heating chamber and the cooling chamber and includes a mold path through which the mold passes. The heat shielding body includes a flexible portion that surrounds the mold path and includes a plurality of independently-bendable flexible pieces arranged in a circumferential direction, and a supporting portion that is continuous with the plurality of flexible pieces on an outer periphery of the flexible portion.

In the casting device according to the present invention, when the mold varied in cross-sectional area depending on a position passes through a portion between the heating chamber and the cooling chamber, the flexible portion of the heat shielding body is bent to fit an outer size of the mold. This makes it possible to minimize a gap between a wall surface of the mold and the heat shielding body, and to effectively perform heat shield between the heating chamber and the cooling chamber. At the same time, deterioration of cooling performance of the cooling chamber is suppressed, which makes it possible to improve temperature gradient of a casting and to improve strength of a casting.

Further, heat shield is effectively performed, which reduces an amount of energy emitted to the cooling chamber, of energy emitted from the heating chamber. Accordingly, a secondary effect of improving energy efficiency is obtainable.

In the heat shielding body according to the present invention, the supporting portion preferably has higher rigidity than the flexible portion. This makes it possible to prevent the flexible portion from hanging down from a base part of the supporting portion toward a distal end. As a result, it is possible to maintain the heat shielding effect by the heat shielding body for a long term.

In the heat shielding body according to the present invention, the supporting portion is preferably sandwiched from top and back sides by members that have higher rigidity than the flexible portion. This makes it possible to reinforce strength of the heat shielding body made of a flexible material, and to accordingly lengthen a lifetime of the heat shielding body. The flexibility here refers to a level of flexibility that can cause a deflection when the mold is contacted.

The mold path provided in the heat shielding body according to the present invention preferably has a shape imitating a cross-sectional shape of the mold or a circular shape. Configuring the mold path in the shape imitating the cross-sectional shape of the mold reduces the gap between the mold and the heat shielding body. This makes it possible to improve the heat shielding effect by the heat shielding body. Further, configuring the mold path in the circular shape facilitates processing of the heat shielding body. This makes it possible to suppress a manufacturing cost.

The flexible pieces adjacent to one another in the heat shielding body according to the present invention are preferably densely arranged in the circumferential direction with slits in between. The slits less in a gap are provided between the flexible pieces adjacent to one another, which makes it possible to further enhance the heat shielding effect by the heat shielding body.

A stress relaxation structure is preferably provided at a boundary between each of the slits and the supporting portion in the heat shielding body according to the present invention. As a result, the stress relaxation structure relaxes stress occurred at distal ends of the respective slits when the mold and the flexible pieces come into contact with one another. This makes it possible to prevent the heat shielding body from being damaged or broken, and to lengthen the lifetime of the heat shielding body.

The heat shielding body according to the present invention preferably includes a multilayer structure of a first heat shielding body and a second heat shielding body. The first heat shielding body preferably includes a first flexible portion that surrounds the mold path and includes a plurality of first independently-bendable flexible pieces arranged in the circumferential direction, and a first supporting portion that is continuous with the plurality of first flexible pieces on an outer periphery of the first flexible portion. The second heat shielding body preferably includes a second flexible portion that surrounds the mold path and includes a plurality of second independently-bendable flexible pieces arranged in the circumferential direction, and a second supporting portion that is continuous with the plurality of second flexible pieces on an outer periphery of the second flexible portion. The first heat shielding body and the second heat shielding body are preferably provided while the plurality of first flexible pieces and the plurality of second flexible pieces are shifted in phase.

With this configuration, the flexible pieces of the second heat shielding body compensate and close the gap between the flexible pieces adjacent to one another provided in the first heat shielding body. This makes it possible to remarkably improve the heat shielding effect by the heat shielding body.

Advantageous Effects of Invention

According to the casting device of the present invention, heat shield is effectively performed between the heating chamber and the cooling chamber. Therefore, it is possible to provide the casting device that makes it possible to appropriately perform precision casting using directional solidification.

DESCRIPTION OF EMBODIMENT

A casting device 1 according to an embodiment of the present invention is described below with reference to accompanying drawings.

The casting device 1 fabricates, for example, gas turbine components such as a rotor blade and a vane that are required to have mechanical strength, through precision casting to which directional solidification is applied. In particular, the casting device 1 is designed to maximize the effect of a heat shielding portion 70 provided between a heating chamber 4 and a cooling chamber 5.

Figure 1:
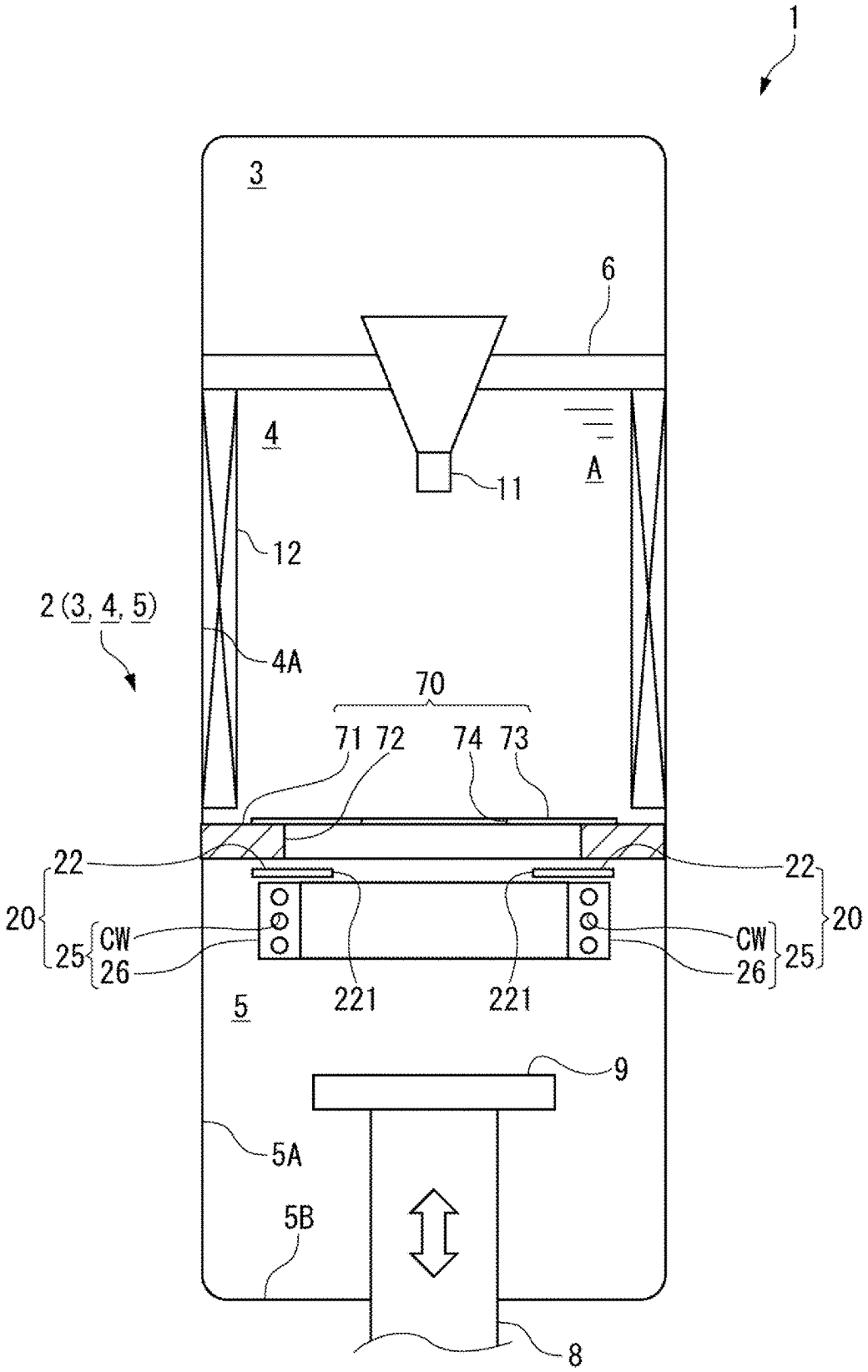
FIG. 1 is a cross-sectional view illustrating a schematic configuration of a casting device according to an embodiment of the present invention.

In the present embodiment, as illustrated in FIG. 1, the casting device 1 includes a vacuum chamber 2 in which an internal space is held in a depressurized state, a pouring chamber 3 that is disposed at a relatively upper part inside the vacuum chamber 2, a heating chamber 4 that is provided below the pouring chamber 3 inside the vacuum chamber 2, and a cooling chamber 5 that is disposed below the heating chamber 4 inside the vacuum chamber 2. A heat shielding portion 6 is provided at a boundary between the pouring chamber 3 and the heating chamber 4, and a heat shielding portion 70 is provided at a boundary between the heating chamber 4 and the cooling chamber 5, inside the vacuum chamber 2.

Figure 2:
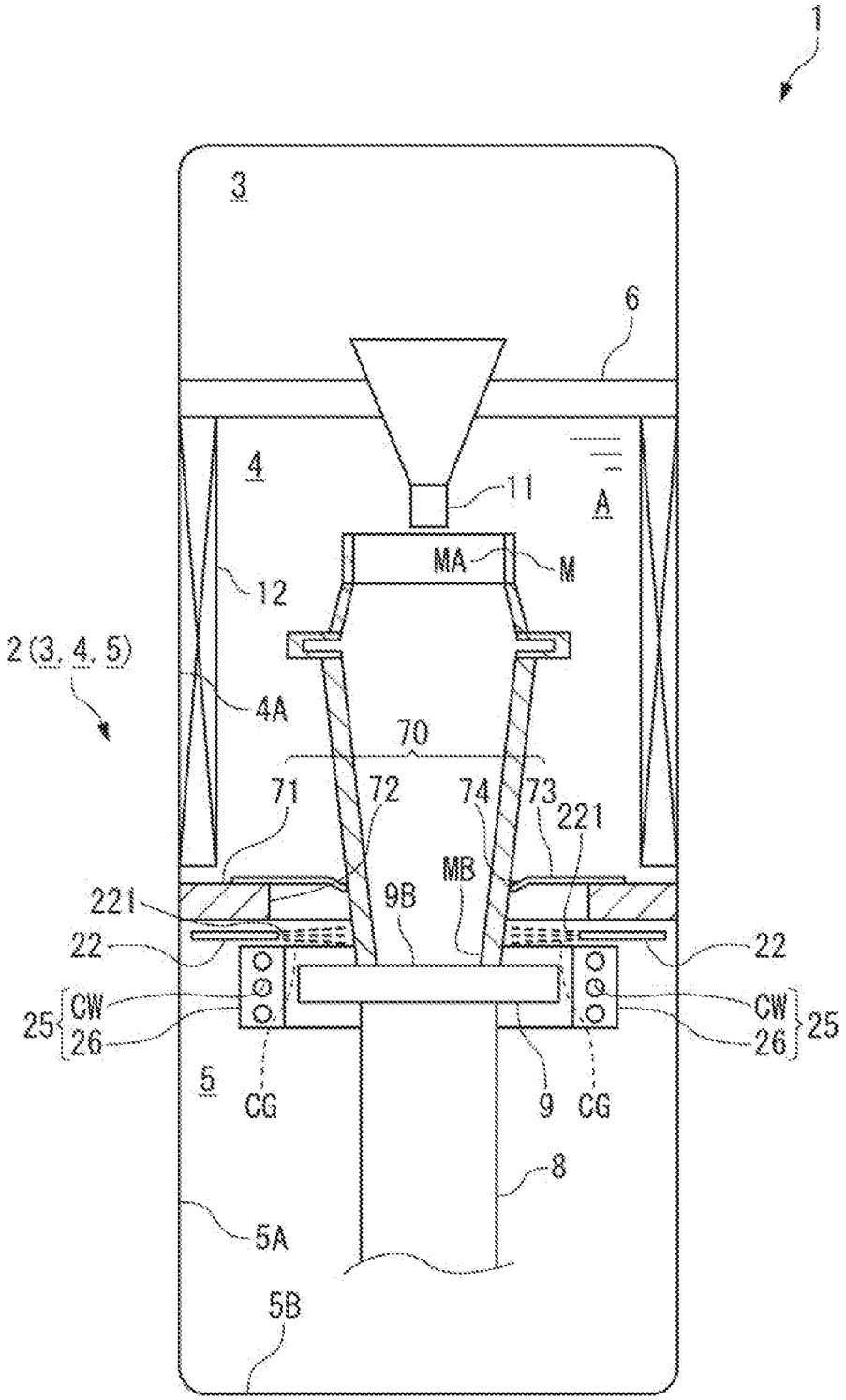
FIG. 2 is a diagram illustrating a state where a lower end part of a mold is moved to a cooling chamber in the casting device according to the present embodiment.

Further, FIG. 2 illustrates a state where a mold M is accommodated inside the casting device 1. As illustrated in FIG. 2, a driving rod 8 that elevates and lowers the mold M, and a cooling table 9 that is provided at a top of the driving rod 8 and supports and cools the mold M from below are provided inside the cooling chamber 5.

The mold M is made of a refractory material, and includes therein a cavity that is a space corresponding to an outer size of, for example, a rotor blade or a vane to be cast, as illustrated in FIG. 2. In the mold M, a dimension of a lower end in a width direction is the smallest, and a dimension of a flange provided near an upper end in the width direction is the largest. The cavity of the mold M includes an upper opening MA at the upper end and a lower opening MB at the lower end, and penetrates through the mold M in a vertical direction. In addition, the cavity of the mold M can be filled with an alloy A in a molten state (corresponding to molten metal of the present invention), from the upper opening MA. In addition, the lower opening MB is closed by the cooling table 9 from below, and the cooling table 9 constitutes a bottom wall 9B of the mold M.

In FIG. 1 and FIG. 2, the internal space of the vacuum chamber 2 is maintained in a substantially vacuum state by operation of an unillustrated vacuum pump, in the casting.

In the pouring, the pouring chamber 3 pours the alloy A in the molten state stored in an unillustrated molten metal ladle, into the mold M through a pouring nozzle 11. The pouring nozzle 11 is supported by the heat shielding portion 6 that is the boundary between the pouring chamber 3 and the heating chamber 4. The unillustrated molten metal ladle is introduced into the pouring chamber 3 from outside before the vacuum chamber 2 is evacuated. Thereafter, after the vacuum chamber 2 is depressurized to vacuum, the alloy A in the molten state is poured from the molten metal ladle.

In the casting, the heating chamber 4 maintains the mold M into which the alloy A in the molten state has been poured, at temperature higher than a melting point of the alloy A. To do so, as illustrated in FIG. 1 and FIG. 2, the heating chamber 4 includes a heater 12. The heater 12 is provided in a cylindrical shape along a circumferential direction of an inner wall surface 4A so as to surround the internal space of the heating chamber 4.

The heat shielding portion 70 is described after description for the cooling chamber 5.

The cooling chamber 5 is a region to solidify the poured alloy A in the molten state, and is maintained at temperature lower than the melting point of the alloy A poured in the mold M and includes a cooling mechanism 20 to forcibly cool the alloy A in the molten state as illustrated in FIG. 1.

The mold M that has received the alloy A in the molten state in the heating chamber 4 is moved to the cooling chamber 5. An upstream and a downstream are defined based on a direction in which the mold M is moved.

As illustrated in FIG. 1, the cooling mechanism 20 includes gas supply nozzles 22 and a radiation cooling portion 25.

Each of the gas supply nozzles 22 includes a plurality of mechanisms each jetting cooling gas CG that is supplied from an unillustrated gas supply source.

The plurality of gas supply nozzles 22 are fixed directly below the heat shielding portion 70 as illustrated in FIG. 1 in a vertical direction, and are provided along a horizontal direction so as to surround the mold M in the horizontal direction. This allows for uniform cooling of the mold M in the horizontal direction. Each of the gas supply nozzles 22 blows the cooling gas CG toward the mold M from a discharge end 221 that is a distal end facing the mold M. As the cooling gas CG blown toward the mold M from the gas supply nozzles 22, inert gas such as argon (Ar) and helium (He) is preferably used in order to suppress oxidation of the alloy A. Further, as temperature of the cooling gas CG, about ambient temperature is sufficient; however, the cooling gas CG at temperature lower than the ambient temperature may be used, in particular, in order to accelerate solidification.

Note that the example in which the gas supply nozzles 22 are fixed directly below the heat shielding portion 70 has been described above. Alternatively, for example, a mechanism in which an unillustrated actuator advances and retreats the gas supply nozzles 22 so as to maintain a constant distance between the gas supply nozzles 22 and the mold M while avoiding interference between the gas supply nozzles 22 and the mold M, may be provided. In this case, advancing and retreating of the gas supply nozzles 22 are performed according to an outer size of the mold M. The gas supply nozzles 22 are controlled so as to be advanced with respect to a part of the mold M having a small outer size, and to be retreated with respect to a part of the mold M having a large outer size. As a result, a constant distance between the discharge ends of the cooling gas CG and the mold M is maintained, which makes it possible to stabilize an effect of cooling the mold M by blowing of the cooling gas.

Next, the radiation cooling portion 25 performs radiation cooling of the mold M. In this case, radiation indicates a phenomenon that energy is transferred from a high-temperature object to a low-temperature object. In a case of the casting device 1, the high-temperature object is the mold M and the low-temperature object is the radiation cooling portion 25.

The radiation cooling portion 25 includes a structure in which a cooling medium such as cooling water CW circulates through, for example, an inside of a ring-shaped water-cooling jacket 26 that is made of copper, a copper alloy, aluminum, an aluminum alloy, or the like with high thermal conductivity. The radiation cooling portion 25 surrounds the mold M to perform radiation cooling of the high-temperature mold M that passes through a hollow part of the radiation cooling portion 25.

The radiation cooling portion 25 is adjacently provided directly below the gas supply nozzles 22, and the gas supply nozzles 22 and the radiation cooling portion 25 are arranged in series to one another in the vertical direction.

The driving rod 8 elevates and lowers the mold M through the cooling table 9.

As illustrated in FIG. 1 and FIG. 2, the driving rod 8 is provided so as to penetrate through a bottom wall 5B of the cooling chamber 5, and is elevated and lowered inside the cooling chamber 5 by an unillustrated actuator while supporting the cooling table 9.

As illustrated in FIG. 1 and FIG. 2, the cooling table 9 supports the mold M from below while closing the lower opening MB of the mold M, and cools the alloy A inside the mold M particularly through the lower opening MB.

As illustrated in FIG. 1, the heat shielding portion 70 partitions the heating chamber 4 and the cooling chamber 5, and suppresses heat transfer therebetween. The heat shielding portion 70 includes a base body 71 that is provided so as to protrude in the horizontal direction from an inner wall surface 5A of the cooling chamber 5 toward a center, and a heat shielding body 73 that is fixed on the base body 71. The base body 71 includes, at a center part, a mold path 72 that allows the heating chamber 4 and the cooling chamber 5 to communicate with each other, and an opening size of the mold path 72 is set larger than the maximum outer size of the mold M. The heat shielding body 73 also includes, at a center part, a mold path 74 that allows the heating chamber 4 and the cooling chamber 5 to communicate with each other, and an opening size of the mold path 74 is set smaller than the opening size of the mold path 72.

The mold M is disposed at a center part of the vacuum chamber 2, and is movable in the vertical direction between the heating chamber 4 and the cooling chamber 5 through the mold path 72 and the mold path 74.

As illustrated in FIG. 5, the heat shielding body 73 includes a flexible portion 76 in which a plurality of independently-bendable flexible pieces 75 are arranged in a circumferential direction, and a supporting portion 77 that is continuous with the plurality of flexible pieces 75 on outer periphery of the flexible portion 76. The heat shielding body 73 has a circular outer shape, and includes, at the center part, the mold path 74 that is a path of the mold M. The mold path 74 is formed in an ellipsoidal shape imitating the cross-sectional shape of the mold M in this example. Alternatively, the mold path 74 may be formed in a circular opening shape or other shape. Slits S (S1, S2, S3, S4, S5, S6, S7, and S8) are radially provided in a region of the heat shielding body 73 from the flexible portion 76 to the supporting portion 77, which section the flexible portion 76 into eight flexible pieces 75 (75A, 75B, 75C, 75D, 75E, 75F, 75G, and 75H). An outer size of the flexible portion 76 is set to allow the part of the mold M having the largest outer size to pass therethrough. The slits S (S1 to S8) used here are cuts provided among the flexible pieces 75 (75A to 7H), and no gap occurs between the flexible pieces 75 (75A to 75H) adjacent to each other when the flexible pieces 75 are not bent. The present invention, however, does not eliminate a gap between the flexible pieces 75 (75A to 75H) adjacent to each other. Note that the expression of the flexible pieces 75 is used to collectively refer to the flexible pieces 75A to 75H, and the expression of the slits S is used to collectively refer to the slits S1 to S8. The expression of stress relaxation structures C described later is similarly used.

Figure 5A:
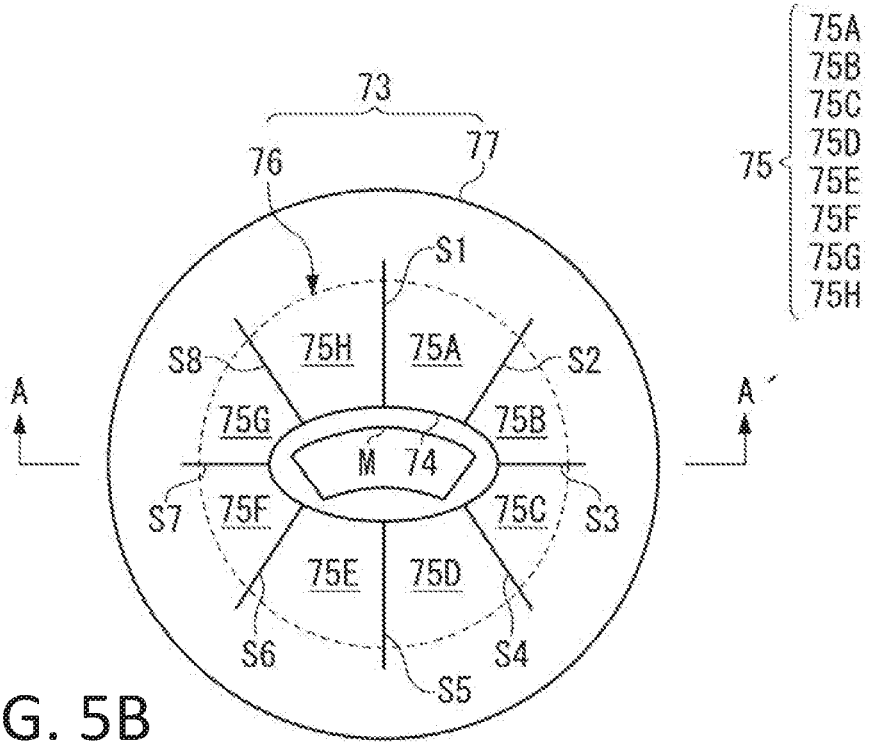
FIGS. 5A to 5D each illustrate a heat shielding body used in the present embodiment, FIG. 5A being a plan view, FIG. 5B being a diagram taken along a line A-A' of FIG. 5A, FIG. 5C being a diagram taken along the line A-A' of FIG. 5A when a part having a large cross-sectional area of the mold passes, and FIG. 5D being a diagram taken along the line A-A' of FIG. 5A when a part having a larger cross-sectional area of the mold passes.
Figure 5B:
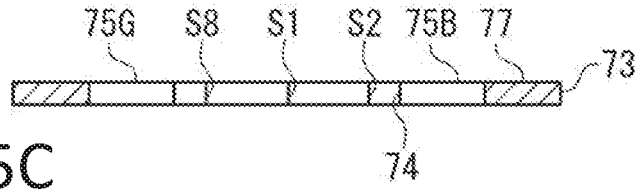
Figure 5C:
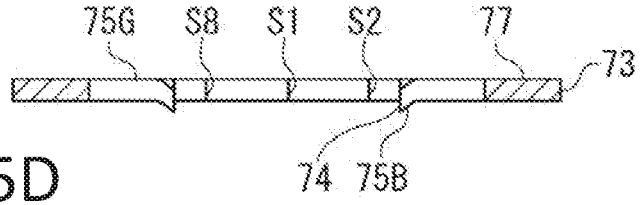
Figure 5D:
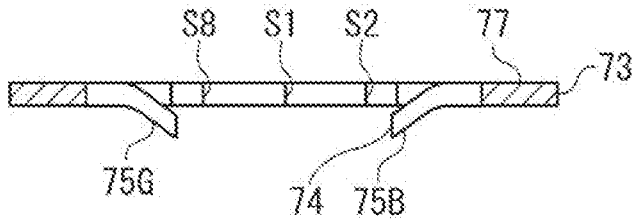

When the mold M does not pass, or when the outer size of the mold M is smaller than the opening size of the mold path 74, the flexible pieces 75 (75A to 75H) are not bent as illustrated in FIG. 5B. When the part of the mold M having the large outer size passes, distal ends of the respective flexible pieces 75 (75A to 75H) are bent downward as illustrated in FIG. 5C. When the part of the mold M having the larger outer size passes through the mold path 74, the flexible pieces 75 (75A to 75H) are largely bent.

As described above, when the mold M passes through the mold path 74, the bend of the flexible pieces 75 (75A to 75H) is increased or decreased depending on the outer size of the mold M, which makes it possible to minimize the gap around the mold M. This makes it possible to reduce heat transfer between the heating chamber 4 and the cooling chamber 5. As a result, heat shield is effectively performed by the heat shielding body 73.

Operation

Next, casting operation by the casting device 1 including the above-described configuration is described.

Pouring Step

As illustrated in FIG. 2, the driving rod 8 is moved to the highest position while the driving rod 8 supports the mold M through the cooling table 9, to place the mold M excluding a part of the lower end, inside the heating chamber 4. Thereafter, the alloy A melted in an unillustrated melting furnace is poured into the mold M from the upper opening MA of the mold M.

Since the heating chamber 4 is maintained at the temperature higher than the melting point of the alloy A, the alloy A in the molten state poured in the mold M is not solidified. On the other hand, the bottom of the poured alloy A in the mold M is solidified earlier by coming into contact with the cooling table 9, and a solidification interface that is a thin solidified part is formed.

In the pouring step, as illustrated in FIG. 2, the discharge ends 221 of the respective gas supply nozzles 22 each stand by at an advanced position that is the closest to a center axis of the casting device 1. In the pouring step, the cooling gas CG may be discharged from the gas supply nozzles 22, or the cooling water CW may circulate through the water-cooling jacket 26.

Cooling Step

Figure 3:
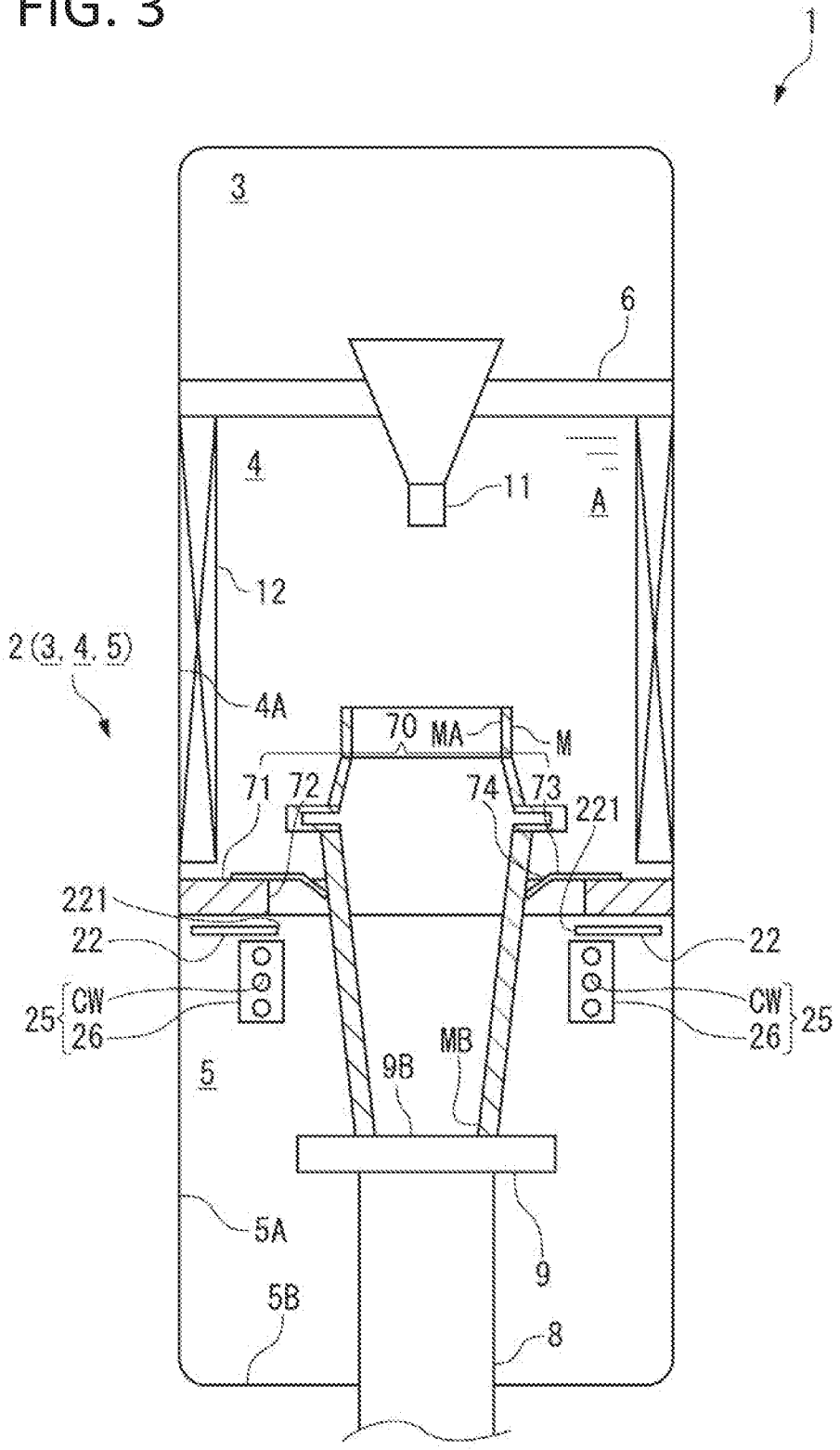
FIG. 3 is a diagram illustrating a state where movement of the mold is progressed from the state of FIG. 2.
Figure 4:
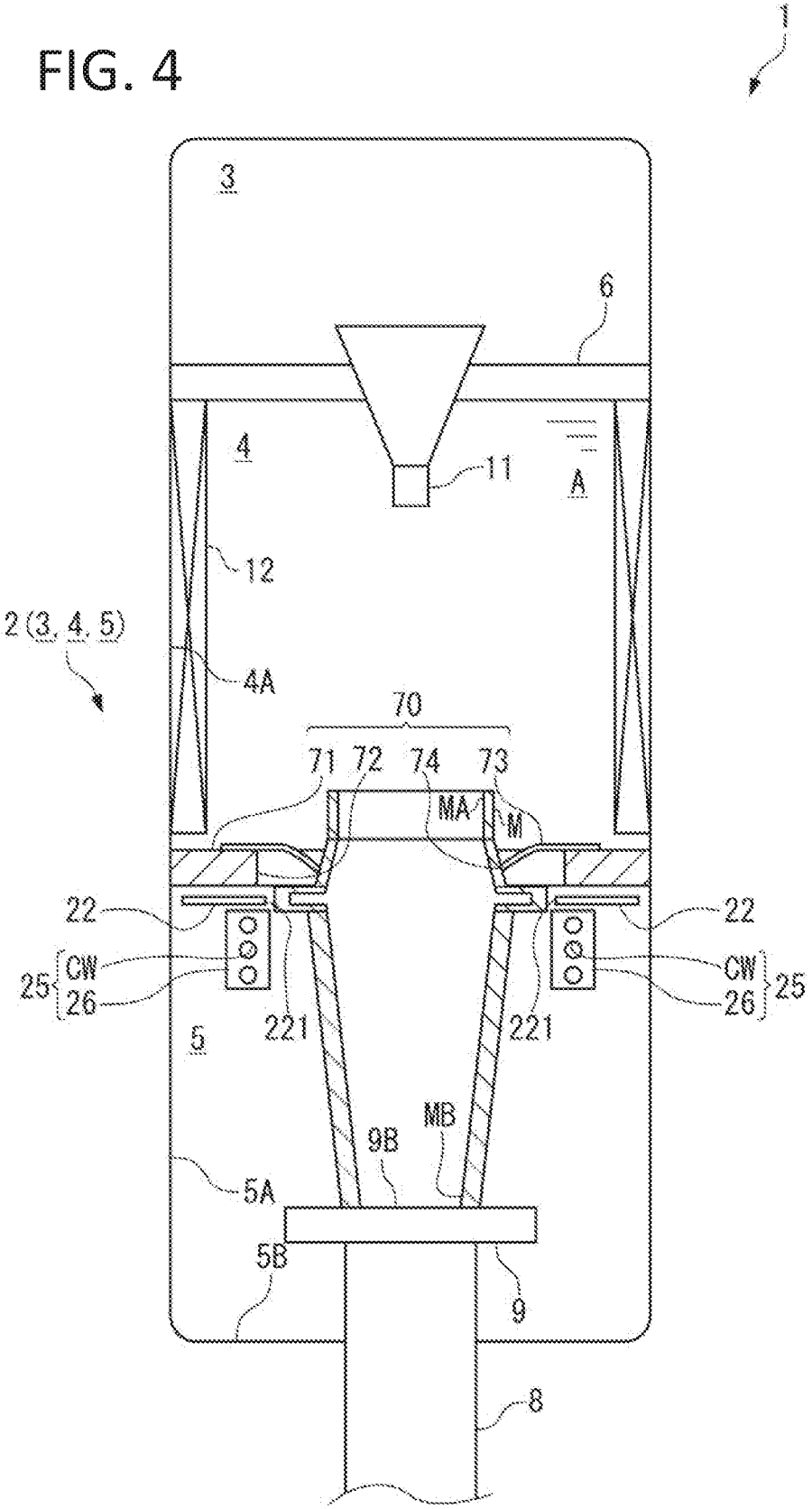
FIG. 4 is a diagram illustrating a state where the movement of the mold is further progressed from the state of FIG. 3.

After a necessary amount of alloy A is poured, the driving rod 8 is lowered, as illustrated in FIG. 3, to move the mold M into the cooling chamber 5 through the mold path 72 of the heat shielding portion 70 at a slow speed. The moving speed of the mold M at this time is, for example, about several tens centimeters per one hour.

Since the inside of the cooling chamber 5 is maintained at the temperature lower than the melting point of the alloy A inside the mold M, the solidification interface is gradually moved upward according to the movement of the mold M into the cooling chamber 5, and directional solidification is accordingly performed.

The cooling gas CG is blown toward the mold M from the gas supply nozzles 22 and the cooling water CW circulates through the water-cooling jacket 26 while the mold M is lowered. This allows the cooling mechanism 20 to cool the mold M directly below the heat shielding portion 70.

After the mold M is lowered in position at a low speed, the cooling step ends. Thereafter, the mold M is taken out from the cooling chamber 5 and is dismantled to obtain a directionally-solidified casting.

Effects

The casting device 1 according to the present embodiment achieves the following effects.

In the casting device 1, the flexible portion 76 of the heat shielding body 73 is bent to fit the outer size of the mold M when the mold M that is varied in the cross-sectional area depending on the position passes through the heat shielding portion 70 between the heating chamber 4 and the cooling chamber 5. Therefore, according to the casting device 1, it is possible to minimize the gap between the wall surface of the mold M and the heat shielding body 73, and to effectively perform heat shield between the heating chamber 4 and the cooling chamber 5.

Preventing deterioration of the cooling performance in the cooling chamber 5 causes steep temperature gradient of a casting. This makes it possible to improve strength of the obtained casting.

Further, the heat shield is effectively performed, which reduces an amount of energy wastefully emitted to a cooling zone, of the energy emitted from the heater 12. This makes it possible to achieve an effect of improving energy efficiency.

Although the preferred embodiment of the present invention has been described above, the configurations described in the above-described embodiment may be selected or appropriately modified without departing from the scope of the present invention.

Figure 6A:
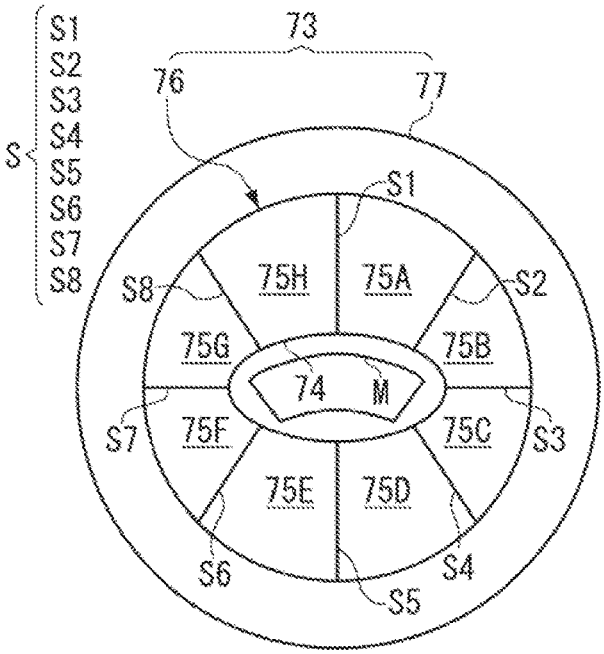
FIGS. 6A to 6C each illustrate a modification of the heat shielding body used in the present embodiment, FIG. 6A being a diagram illustrating a heat shielding body including a supporting portion with high rigidity, FIG. 6B being a diagram illustrating a heat shielding body that includes a circular mold path, and FIG. 6C being a diagram illustrating a heat shielding body including a stress relaxation structure.

For example, as illustrated in FIG. 6A, in the heat shielding body 73, the supporting portion 77 may be made of a material with heat resistance and high rigidity, such as a carbon plate. As a result, the supporting portion 77 that has higher rigidity than the flexible portion 76 supports bend of the flexible portion 76 from a base part toward a distal end due to own weight. This allows the heat shielding effect by the heat shielding body 73 to effectively act.

Note that the flexible portion 76 may be made of a material with heat resistance and flexibility, for example, a carbon felt having a thickness of 1 mm to 30 mm.

Figure 6B:
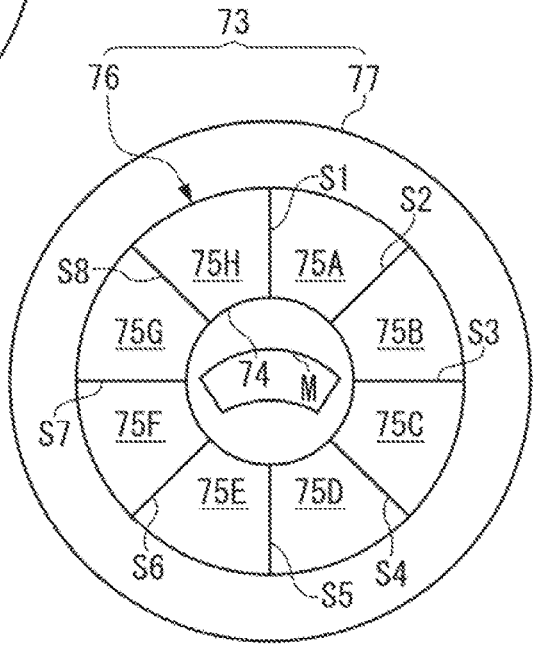

Further, as illustrated in FIG. 6B, the mold path 74 may be formed in a circular shape that is easily processed. This makes it possible to suppress a manufacturing cost of the heat shielding body 73 to low.

Figure 6C:
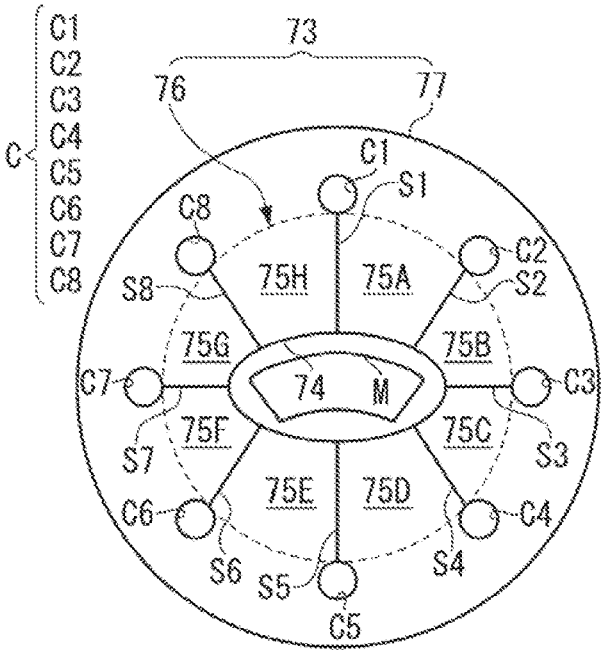

Further, as illustrated in FIG. 6C, in the heat shielding body 73 described with reference to FIGS. 5A to 5D, distal end parts of the respective slits S (S1 to S8) may include stress relaxation structures C (C1, C2, C3, C4, C5, C6, C7, and C8) that each include a circular through hole. In this configuration, the stress relaxation structures C (C1 to C8) relax stress occurred at the distal ends of the slits S (S1 to S8) due to contact between the mold M and the flexible pieces 75 (75A to 75H). This prevents the heat shielding body 73 from being damaged or broken, which makes it possible to lengthen a lifetime of the heat shielding body 73. Note that the circular example has been described here as the stress relaxation structure; however, a through hole in other shape may be used.

Figure 7A:
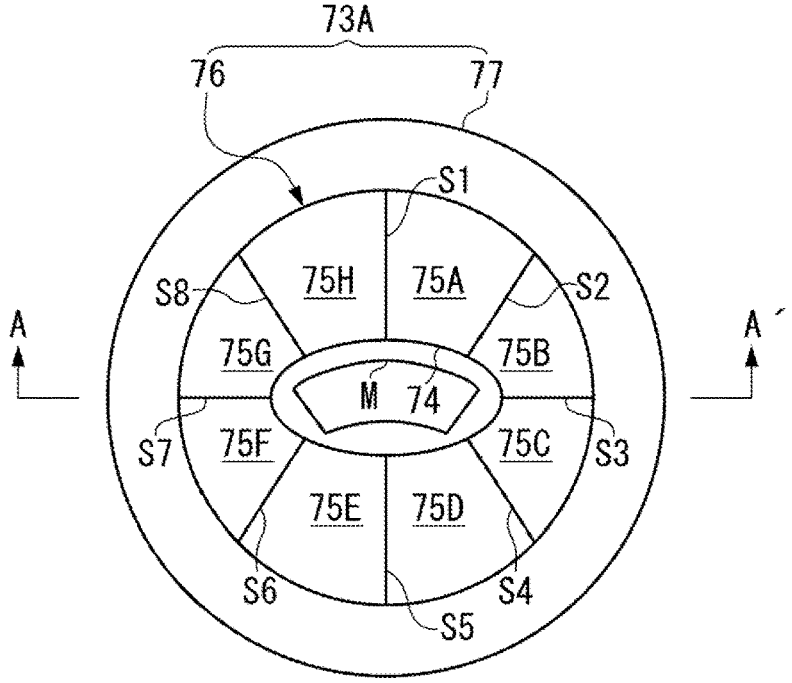
FIGS. 7A to 7C each illustrate the heat shielding body including a multilayer structure used in the present embodiment, FIG. 7A being a plan view of a first heat shielding body, FIG. 7B being a plan view of a second heat shielding body, and FIG. 7C being a diagram taken along a line A-A' of FIG. 7A and a diagram taken along a line B-B' of FIG. 7B when the first heat shielding body and the second heat shielding body are stacked.
Figure 7B:
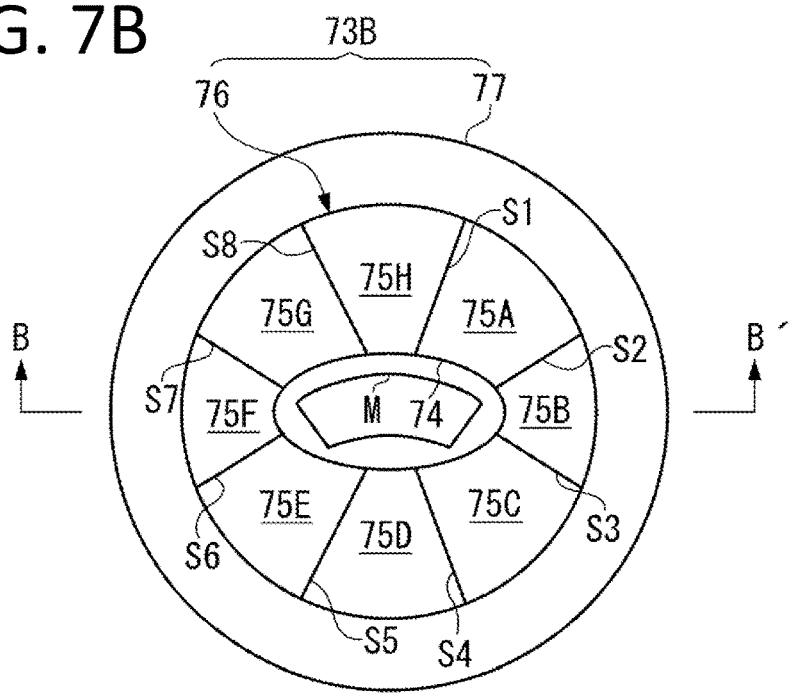
Figure 7C:
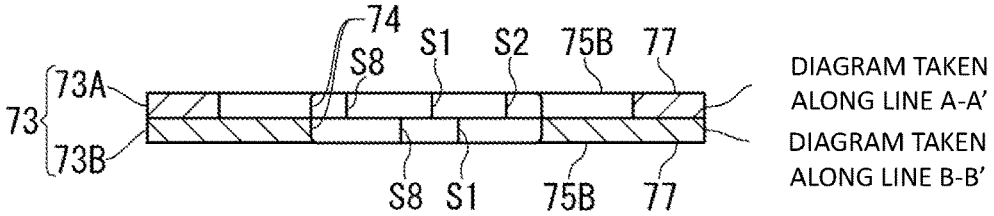

Further, as illustrated in FIGS. 7A to 7C, the heat shielding body 73 may have a multilayer structure of a first heat shielding body 73A and a second heat shielding body 73B. In this example, as illustrated in FIG. 7A, the first heat shielding body 73A includes the first flexible portion 76 that surrounds the mold path 74 and includes the plurality of first independently-bendable flexible pieces 75 (75A, 75B, 75C, 75D, 75E, 75F, 75G, and 75H) arranged in the circumferential direction, and the first supporting portion 77 that is continuous with the plurality of first flexible pieces 75 (75A to 75H) on the outer periphery of the first flexible portion 76. Likewise, as illustrated in FIG. 7B, the second heat shielding body 73B includes the second flexible portion 76 that surrounds the mold path 74 and includes the plurality of second independently-bendable flexible pieces 75 (75A to 75H) arranged in the circumferential direction, and the second supporting portion 77 that is continuous with the plurality of second flexible pieces 75 (75A to 75H) on the outer periphery of the second flexible portion 76. In this example, in the first heat shielding body 73A and the second heat shielding body 73B, the plurality of first flexible pieces 75 (75A to 75H) and the plurality of second flexible pieces 75 (75A to 75H) are provided while being shifted in phase. A dimension and a shape of the first heat shielding body 73A and a dimension and a shape of the second heat shielding body 73B are coincident with each other except that the phase is shifted. Note that the first heat shielding body 73A and the second heat shielding body 73B may be stacked so as to come into contact with each other without a gap as illustrated in FIG. 7C. Alternatively, the first heat shielding body 73A and the second heat shielding body 73B may be stacked with a predetermined gap.

The slits S (S1 to S8) are provided while being shifted in phase. As a result, when the flexible portion 76 of the first heat shielding body 73A is bent to fit the outer size of the mold M, for example, even if the slit S1 between the flexible piece 75A and the flexible piece 75H is largely opened due to bend of the flexible piece 75A and bend of the flexible piece 75H, the flexible piece 75H of the second heat shielding body 73B compensates and closes a part of the slit S1 widely opened. This makes it possible to remarkably improve heat shielding effect by the heat shielding body 73 (first heat shielding body 73A and second heat shielding body 73B).

The example in which the flexible piece 75 and the flexible piece 75 adjacent to each other do not include a gap by the slit S (S1 to S8) in a state where the flexible pieces 75 are not bent has been described above. If a predetermined gap is provided between the flexible piece 75 and the flexible piece 75 adjacent to each other, however, the flexible piece 75 of the second heat shielding body 73B compensates and closes the gap between the flexible pieces adjacent to each other of the first heat shielding body 73A. This makes it possible to similarly improve the heat shielding effect.

Further, in the example of FIGS. 7A to 7C, the heat shielding body 73 includes two layers (first heat shielding body 73A and second heat shielding body 73B). To achieve larger heat shielding effect, the number of stacked layers may be increased to three or four layers, which makes it possible to achieve more remarkable heat shielding effect.

Figure 8A:
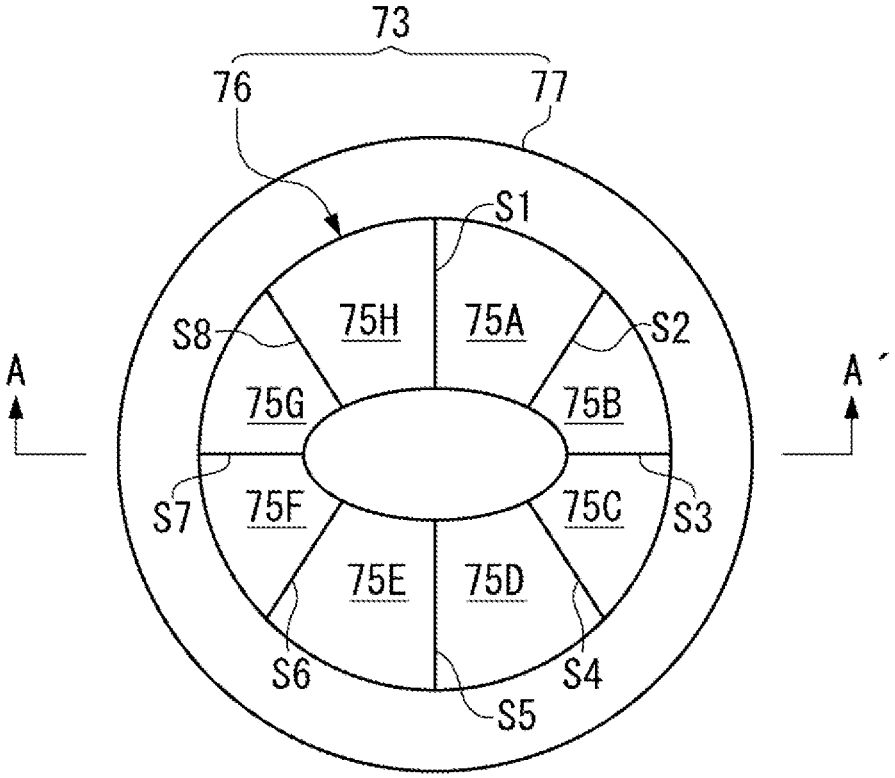
FIGS. 8A and 8B each illustrate the heat shielding body including a reinforcing body used in the present embodiment, FIG. 8A being a plan view, and FIG. 8B being a diagram taken along a line A-A' of FIG. 8A.
Figure 8B:
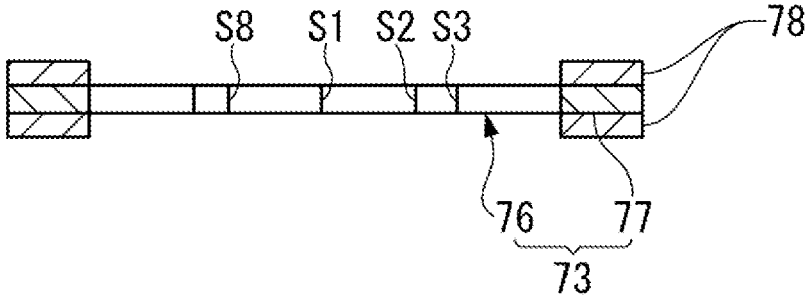

Moreover, as illustrated in FIGS. 8A and 8B, in the heat shielding body 73, the supporting portion 77 of the heat shielding body 73 may be sandwiched from top and back sides by reinforcing bodies 78 made of a hard material. This makes it possible to reinforce strength of the heat shielding body 73 made of a flexible material, and to lengthen the lifetime of the heat shielding body 73.

REFERENCE SIGNS LIST

1 Casting device
2 Vacuum chamber
3 Pouring chamber
4 Heating chamber
4A Inner wall surface
5 Cooling chamber
5A Inner wall surface
5B Bottom wall
6 Heat shielding portion
8 Driving rod
9 Cooling table
9B Bottom wall
11 Pouring nozzle
12 Heater
20 Cooling mechanism
22 Gas supply nozzle
221 Discharge end
25 Radiation cooling portion
26 Water-cooling jacket
70 Heat shielding portion
71 Base body
72 Mold path
73 Heat shielding body
73A First heat shielding body
73B Second heat shielding body
74 Mold path
75A, 75B, 75C, 75D, 75E, 75F, 75G, 75H Flexible piece
76 Flexible portion
77 Supporting portion
78 Reinforcing body
S1, S2, S3, S4, S5, S6, S7, S8 Slit
C1, C2, C3, C4, C5, C6, C7, C8 Stress relaxation structure
CG Cooling gas
CW Cooling water
M Mold
MA Upper opening
MB Lower opening

The invention claimed is:

1. A casting device, comprising:

a heating chamber in which a molten metal is to be poured into a mold;

a cooling chamber that is adjacent to the heating chamber and in which directional solidification is to be performed while the mold poured with the molten metal is moved; and a heat shielding body that partitions the heating chamber and the cooling chamber and includes a mold path through which the mold is to pass, wherein:

the heat shielding body includes a flexible portion that surrounds the mold path and includes a plurality of independently-bendable flexible pieces arranged in a circumferential direction, and a supporting portion that is continuous with the independently-bendable flexible pieces on an outer periphery of the flexible portion;

the independently-bendable flexible pieces adjacent to one another are arranged in the circumferential direction with slits in between;

a stress relaxation structure is provided at a boundary between each of the slits and the supporting portion; and the stress relaxation structure includes a circular through hole defined in the supporting portion.

2. The casting device according to claim 1, wherein the flexible portion is configured to bend to fit an outer size of the mold.

3. A casting device, comprising:

a heating chamber in which a molten metal is to be poured into a mold;

a cooling chamber that is adjacent to the heating chamber and in which directional solidification is to be performed while the mold poured with the molten metal is moved; and a heat shielding body that partitions the heating chamber and the cooling chamber and includes a mold path through which the mold is to pass, wherein:

the heat shielding body includes a multilayer structure of a first heat shielding body and a second heat shielding body;

the first heat shielding body includes a first flexible portion that surrounds the mold path and includes a plurality of first independently-bendable flexible pieces arranged in a circumferential direction, and a first supporting portion that is continuous with the first independently-bendable flexible pieces on an outer periphery of the first flexible portion, the first independently-bendable flexible pieces adjacent to one another being arranged in the circumferential direction with first slits in between;

the second heat shielding body includes a second flexible portion that surrounds the mold path and includes a plurality of second independently-bendable flexible pieces arranged in the circumferential direction, and a second supporting portion that is continuous with the second independently-bendable flexible pieces on an outer periphery of the second flexible portion, the second independently-bendable flexible pieces adjacent to one another being arranged in the circumferential direction with second slits in between; and the first heat shielding body and the second heat shielding body are stacked with each other such that the first independently-bendable flexible pieces and the second independently-bendable flexible pieces are configured to be shifted in phase.

* * * * *